US006419175B1

(12) United States Patent
Rankin, VI

(10) Patent No.: US 6,419,175 B1
(45) Date of Patent: Jul. 16, 2002

(54) RETRACTOR HAVING A SWIVEL ATTACHMENT COMPONENT

(75) Inventor: Alexander Rankin, VI, Dresher, PA (US)

(73) Assignee: Vulcan Spring & Manufacturing Company, Telford, PA (US)

( * ) Notice: Subject to any disclaimer, the term of this patent is extended or adjusted under 35 U.S.C. 154(b) by 0 days.

(21) Appl. No.: 09/779,119

(22) Filed: Feb. 8, 2001

(51) Int. Cl.[7] ..... B65H 75/48
(52) U.S. Cl. ..... 242/373; 242/379.2; 242/399.2
(58) Field of Search ..... 242/373, 377, 242/379.2, 404, 399.2

(56) References Cited

U.S. PATENT DOCUMENTS

| | | | | | |
|---|---|---|---|---|---|
| 2,308,771 | A | * | 1/1943 | Mooney | 242/377 |
| 2,503,526 | A | * | 4/1950 | Thompson | 242/377 |
| 3,547,371 | A | * | 12/1970 | Gruseck | 242/377 |
| 4,187,996 | A | | 2/1980 | Ehrlich | |
| 5,104,056 | A | * | 4/1992 | Jannotta et al. | 242/373 |
| 5,124,685 | A | | 6/1992 | Rankin | 340/568 |
| 5,251,464 | A | * | 10/1993 | Halter | 242/379.2 |
| 5,490,805 | A | * | 2/1996 | Bredesen | 242/379.2 |
| 5,893,528 | A | * | 4/1999 | Strokosz et al. | 242/373 |
| 5,938,137 | A | * | 8/1999 | Poulson | 242/379.2 |
| 6,019,304 | A | * | 2/2000 | Showronski et al. | 242/373 |
| 6,039,496 | A | | 3/2000 | Bishop | 403/4 |
| 6,290,158 | B1 | * | 9/2001 | Huang | 242/379.2 |

OTHER PUBLICATIONS

Vulcan Spring & Mfg. Co., "Vulcan Pullbox®" brochure, 1996.

* cited by examiner

*Primary Examiner*—John M. Jillions
(74) *Attorney, Agent, or Firm*—Howson and Howson

(57) ABSTRACT

A retractor having a retractable tether and a spring biased reel providing a retracting force throughout the full extension of the tether to take up any slack in the tether and to return the tether to its normal wound storage position on the reel. The retractor having a housing and a swivel attachment component extending from the housing which enables the housing of the retractor to pivot relative to the surface to which the retractor is connected. The general structure of the swivel attachment component permits ready assembly of any one of various configured swivel attachment components to the retractor housing.

15 Claims, 2 Drawing Sheets

RETRACTOR HAVING A SWIVEL ATTACHMENT COMPONENT

FIELD OF THE INVENTION

The present invention relates to a retractor device having a retractable tether and a spring biased reel providing a retracting force throughout the full extension of the tether to take up any slack in the tether and to return the tether to its normal wound storage position on the reel, and more particularly, the present invention relates to a constant pull retractor having a swivel attachment component which enables the housing of the retractor to pivot relative to the surface to which the retractor is connected.

BACKGROUND OF THE INVENTION

There exist many uses for tethers in which an otherwise loose object is connected to another object with an unbreakable chain or flexible wire. For instance, pens may be tethered to a table top; security badges, keys, identification cards, lift tickets and the like may be tethered to a person or other object; and goods may be tethered to a display fixture for security purposes.

An example of a constant pull cable retractor is disclosed in U.S. Pat. No. 5,124,685 which issued to Rankin and which is assigned to the assignee of the present application. As best illustrated in FIGS. 3 and 5 of the '685 patent, a cable is retracted onto a reel by a constant force spring fixed at an inner end to the periphery of a spring hub and at an outer end to the periphery of a cylindrical flange which coaxially extends from the side of the reel and rotates therewith. The spring winds in opposite directions onto the coaxial reel flange and the spring hub. That is, as the spring unwinds from the spring hub, it winds onto the coaxial reel flange, and vice versa. A permanent inward camber along the length of the spring relative to the spring hub produces a torque on the reel in a direction which retracts the cable with substantially constant pull throughout its full extension. Other examples of constant pull retractors are those manufactured and sold under the Pullbox® trademark by Vulcan Spring & Mfg. Co. of Telford, Pa.

The housings of the above referenced retractors are rigidly secured with adhesives, screws or other fasteners to a mounting surface. The retractable tether extends through an exit port formed in the stationary retractor housing. Thus, the exit port is stationary relative to the mounting surface.

One problem with manufacturing small-sized, or miniature, constant pull retractors is that the relatively small gauge retractor cable, or other retractor components adjacent the cable exit port, can rapidly become worn or fail due to the contact between the tensioned cable and the adjacent retractor components. This is particularly a problem when the cable, or tether, is pulled in a direction other than forward relative to the exit port.

While the above referenced retractors function properly for their intended purposes, there is a need for a retractor which can be provided in a relatively small, or miniature, size and which has a long service life. Preferably, the retractor should have a retractable cable extendable from a housing which is freely rotatable relative to a mounting surface so that the retractor cable exit port always points substantially toward the direction of pull of the retractable cable. In addition, the retractor should be capable of ready attachment to a mounting surface and should be inexpensive to manufacture and assemble.

OBJECTS OF THE INVENTION

With the foregoing in mind, a primary object of the present invention is to provide a small-sized, or miniature, constant pull retractor which has a long service life.

Another object of the present invention is to provide a constant pull retractor with an attachment component which can be readily secured to a mounting surface and which permits the retractor to pivot, or swivel, relative to the mounting surface.

A further object of the present invention is to provide a constant pull retractor which can be inexpensively manufactured and readily assembled.

SUMMARY OF THE INVENTION

More specifically, the present invention provides a retractor having a housing with a rotatable reel captured therein. A cable is wound on the reel and has a terminal end extending exteriorly of the housing such that the cable is extendable from the housing and is retractable onto the reel by the force of spring located in the housing. The terminal end of the cable has an end fitting and is prevented from retracting into the housing. An attachment component extends from the retractor housing and has an attachment surface located exteriorly of the housing. Thus, when the attachment surface of the attachment component is mounted to a mounting surface, the retractor housing is permitted to freely pivot relative to the mounting surface and the attachment component.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
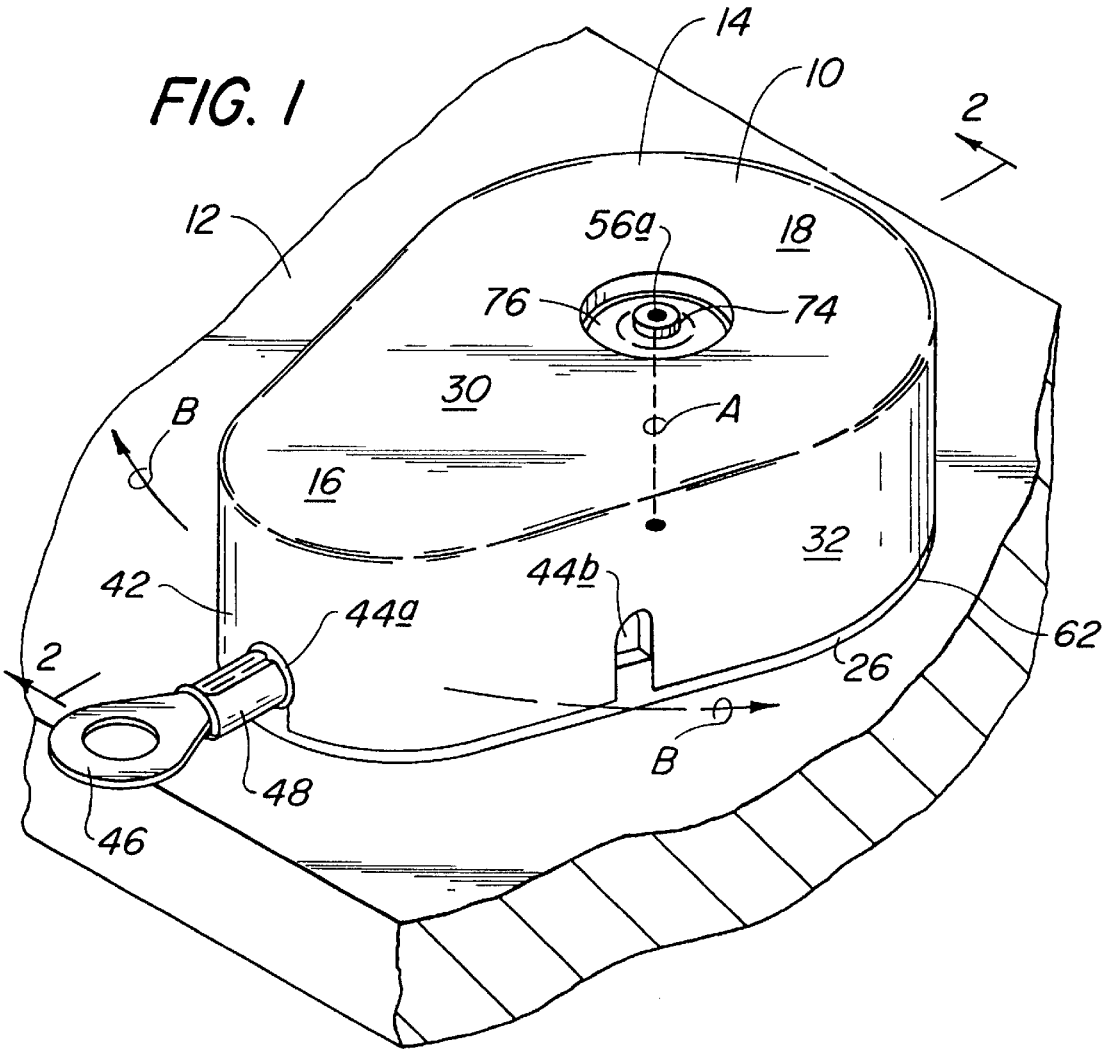
FIG. 1 is a perspective view of a retractor connected to a mounting surface according to the present invention.

Referring now to the drawings, FIG. 1 illustrates a retractor 10 which has a construction according to the present invention and which is secured to a stationary mounting surface 12 such that the retractor can pivot 360° about an axis "A". In FIG. 1, the retractor 10 is drawn to a scale of about twice the size of the actual retractor 10. Thus, the retractor 10 is relatively small, or miniature, and is particularly suited for uses involving, for instance, attaching a pen to a table top or attaching keys, identification cards, tickets and like objects to a person or another object. By way of example, and not by way of limitation, the illustrated retractor can have a housing 14 which is about 2.0 inches in length, 1.25 inches in width, and 0.63 inches in thickness.

Preferably, as illustrated, the housing 14 of the retractor 10 is substantially pear-shaped, or oval, in plan with one end 16 being markedly tapered relative to the larger opposite end 18. The larger end 18 houses a reel 20 for a retractable cable 22. The reel 20 has a circular periphery and rotates about axis "A". The tapered end 16 provides an exit port, or slot, 44*a* through which the retractable cable 22 extends. An alternate exit port 44*b* is provided intermediate of the larger end 18 and tapered end 16 to provide the option of having the cable 22 extend laterally through the housing 14 instead of through the tapered end 16. The larger end 18 also houses a spring 24 which provides a force on the cable 22 to retract the cable 22 onto the reel 20. The above described retractor has an extremely compact construction which can be provided in small sizes.

The construction of the retractor 10 also provides for ready assembly of parts. To this end, the housing 14 is provided by a base section 26 and a cover 28 which are secured together by a friction fit, snap engaging mechanism, screws, adhesives, welds, or other known fastening mechanisms. The cover 28 includes an upper pear-shaped wall 30 and a depending peripheral sidewall 32 which mates with the base section 26 to form the housing 14. Preferably, a hollow cylindrical flange (not shown) depends from the inner face of the upper wall 30 such that the flange extends concentric with axis "A", permits the reel 20 to be rotatably mounted to the housing 14, and forms an open channel 72 extending through the housing 14. Thus, during assembly, the reel 20 is positioned on the hollow cylindrical flange in end 18 of the cover 28 and the base section 26 is applied to the free end of the sidewall 32 to capture the reel 20 in the housing 14.

The reel 20 has a lower hub 34 on which the cable 22 is wound and an upper hub 36 on which the leading end of the spring 24 is wound. The reel 20 has a hollow central portion which is concentric with axis "A" and which rotatably mounts on the hollow cylindrical flange extending from the cover 28 of the housing 14.

The cable 22 has a terminal end 40 which extends from the reel 20 through the exit slot 44*a* formed in the apex 42 of the tapered end 16 of the housing 14, or alternatively, through the alternate exit slot 44*b* formed in the side of the housing 14. The terminal end 40 has an end fitting 46 which, as illustrated, is a loop. Other end fittings known in the art can be utilized. The end fitting 46 prevents the terminal end 40 from being retracted into the housing 14 and provides a means of connecting the cable 22 to an object (not shown) which is to be tethered to the housing 14. Preferably, a protective collar 48 is provided adjacent the slot 44*a*, or 44*b*, to prevent premature wear of the housing 14 adjacent the slot 44*a*, or 44*b*, and to provide added protection from the terminal end 40 being retracted completely into the housing 14.

The spring 24 is preferably a constant force spring which has a memorized wound shape. The leading outer end of the spring is attached to, and is partially wound on, the upper hub 36 of the reel 20. A remaining wound portion 50 of the spring 24 is captured in the tapered end 16 of the housing between the upper wall 30 of the cover 28 and a raised support surface 52 projecting from the base 26. Thus, the remaining wound portion 50 of the spring 24 is not attached about a hub; rather, it is merely freely positioned in the tapered end 16 during assembly of the retractor 10.

In use, as the cable 22 is pulled and intentionally unwound from reel 20, the spring 24 unwinds from the tapered end 16 of the housing 14 and is wound in an opposite direction onto the lower hub 36 of the reel 20. As the cable 22 is retracted back onto the reel 20, the spring 24 is wound into the tapered end 16 and is unwound from the lower hub 36 of the reel 20. A permanent inward camber along the length of the spring 24 relative to the lower hub 36 produces a torque on the reel 20 in a direction which retracts the cable 22 with substantially constant pull throughout the full extension of the cable 22.

Figure 2:
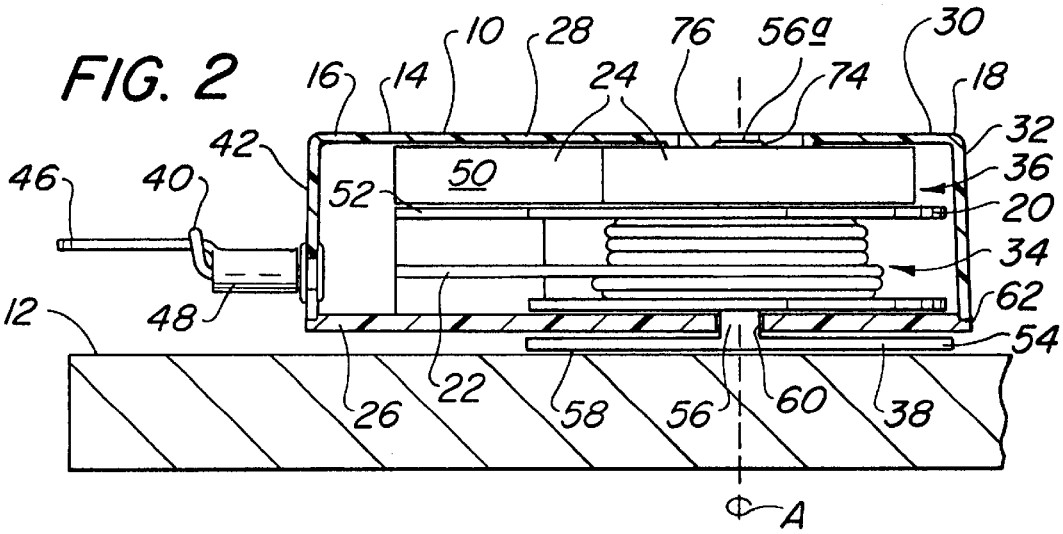
FIG. 2 is a cross-sectional view of the retractor and mounting surface taken along line 2—2 of FIG. 1.

One of the unique aspects of the present invention is the swivel attachment component 38 which extends from the housing 14. As illustrated in FIG. 2, preferably the swivel 38 includes a substantially flat disc shaped member 54 and an integral stem 56 projecting centrally and perpendicularly therefrom to a free end 56*a*. The stem 56 extends through the channel 72 of the housing 14 and its free end 56*a* is secured with a fastener 74 to secure the swivel component 38 to the housing 14 such that the housing 14 is rotatable relative to the swivel 38 about axis "A". Thus, axis "A" forms the axis of rotation of the housing 14 relative to the swivel 38 and the reel 20 relative to the housing 14.

Preferably, the flat disc shaped member 54 of the swivel 38 is located adjacent the exterior side of the base section 26 of the housing 14 and does not extend beyond the outer periphery 62 of the base section 26. The flat member 54 has an attachment surface 58 to which the member 54 is secured to a mounting surface, such as surface 12 illustrated in the drawings. When the attachment surface 58 of the member 54 is attached to the mounting surface 12, the housing 14 of the retractor 10 is permitted to pivot about the stem 56 along axis "A" as illustrated by the arrows "B" in FIG. 1. Thus, as the cable 22 is pulled in different directions, the housing 14 is permitted to rotate such that the tapered end 16 is always pointed substantially toward the direction of pull.

During assembly, the stem 56 is inserted through an aperture 60 located in the base section 26 and is received and captured within the hollow open channel 72 extending through the housing 14. The fastener 74 is secured to the free end 56*a* of the stem 56 to prevent the withdraw of the stem 56 from the channel 72. Preferably, as illustrated in FIG. 1, the upper wall 30 of the cover 28 has a recess 76 adjacent the free end 56*a* of the stem 56 so that the fastener 74 is seated below the upper surface of the upper wall 30.

Figure 3:
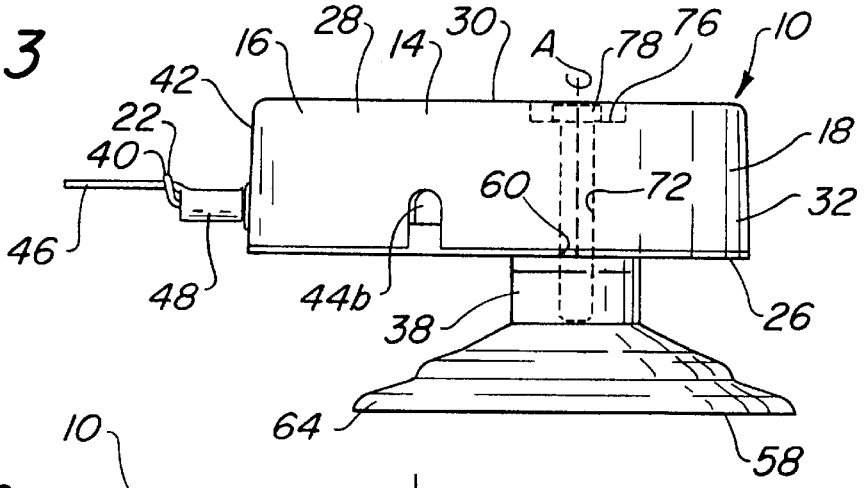
FIG. 3 is a side elevational view of a retractor according to the present invention having a suction cup attachment component.

Various other means for connecting the swivel 38 to the housing 14 are contemplated. For example, the distal end of the stem 56 can be provided with an expandable securement component (not shown) which permits initial insertion into the housing 14 and which expands thereafter to prevent the stem 56 from being reversely pulled from the housing after initial assembly. Other techniques, such as welding techniques, can also be utilized to secure the stem 56 to the housing 14. Alternatively, as illustrated in FIG. 3, a separate headed fastener 78, such as a threaded screw, can be inserted through the channel 72 and thereafter be connected to an attachment component, such as the illustrated suction cup 64.

Figure 4:
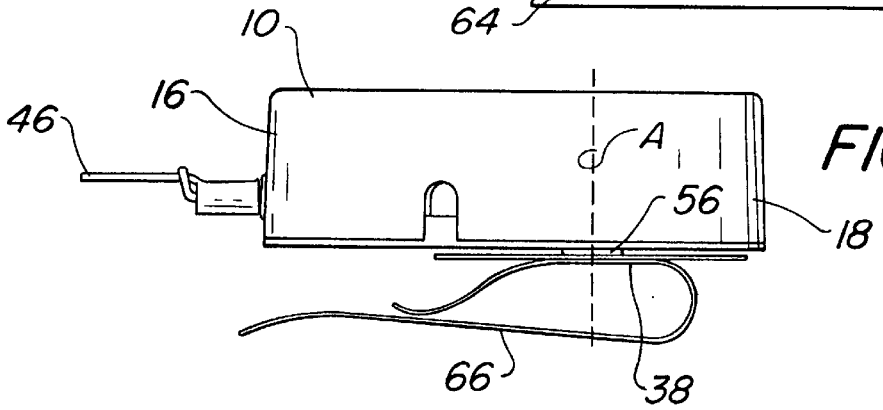
FIG. 4 is a side elevational view of a retractor according to the present invention having a belt clip attachment component.
Figure 5:
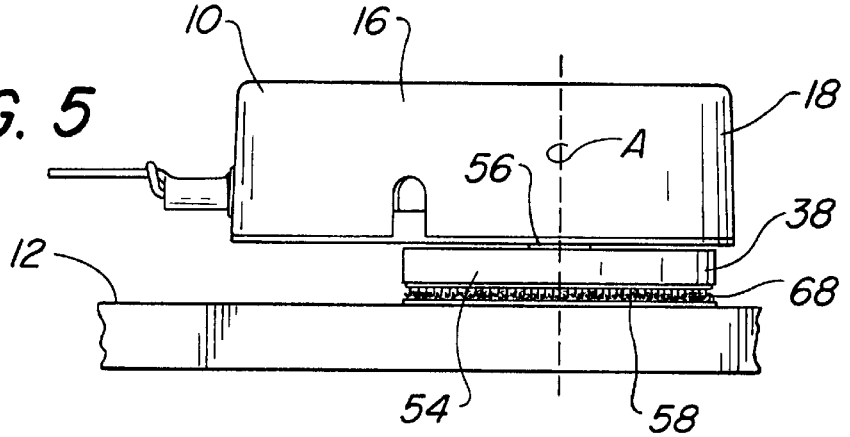
FIG. 5 is a elevational view of a retractor according to the present invention having a hook and loop fastener attachment component.
Figure 6:
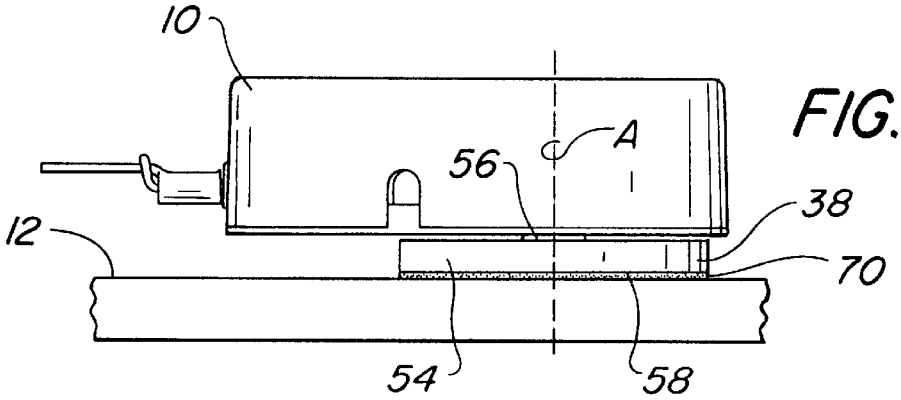
FIG. 6 is a side elevational view of a retractor according to the present invention having a double-sided adhesive tape attachment component.

Various attachment components can be utilized to attach the swivel 38 to a mounting surface 12 or like object. For example, a suction cup 64 (FIG. 3), a clip such as a belt clip 66 (FIG. 4), hook and loop fasteners 68 (FIG. 5) and a double-sided adhesive tape 70 (FIG. 6) can be utilized.

Another alternative is to attach the retractor 10 without the use of a swivel 38 to an elongate string, rod or the like (not shown). For example, a string necklace or the like can be threaded through the channel 72 of the retractor 10 to capture the retractor 10 on the necklace so that the necklace and supported retractor 10 can be worn around a person's neck. In this case, a security badge, key, ticket, or like object can be tethered to the retractor 10 and readily accessed by the wearer of the necklace. Another example is to support several retractors 10 on a rigid rod (not shown) by inserting the end of the rod through the channel 72 of each retractor 10. In this example, articles can be tethered to the retractors 10 which are rotatable and slidable relative to the rod.

Thus, the above-described retractor 10 used in combination with an attachment means according to the present invention provides a unique manner of tethering relatively lightweight objects to a mounting surface. The unique construction of the retractor permits the efficient manufacture and assembly of relatively small sized retractors which have a long service life.

While a preferred retractor has been described in detail, various modifications, alterations, and changes may be made without departing from the spirit and scope of the retractor according to the present invention as defined in the appended claims.

What is claimed is:

1. A retractor device, comprising:

a housing having a rotatable reel mounted therein, said reel having a cable hub and a spring hub with a channel extending therethrough and through the housing;

a cable wound on said cable hub of said reel and having a terminal end extending exteriorly of said housing, said cable being extendable from said housing and being retractable onto said reel, said terminal end having an end fitting for use in connecting an object to be tethered from said housing to said cable;

a spring located in said housing for retracting said cable onto said reel, said spring being a constant force spring having a first wound portion positioned in said housing remote from said channel and a second wound portion wound on said spring hub of said reel in an opposite direction relative to said first wound portion such that, as said spring unwinds from said first wound portion, it winds onto said spring hub, and as said spring unwinds from said spring hub, it winds into said first wound portion; and a swivel attachment component extending from said housing and having an attachment surface located exteriorly of said housing, said housing being rotatable relative to said attachment component about an axis of rotation which extends through said channel and which also defines an axis of rotation of said reel, said swivel attachment component including a stem component which extends through said channel such that said housing is rotatable about said stem component;

whereby, when said attachment surface is secured to a mounting surface, said retractor device is pivotable relative to the mounting surface and said swivel attachment component.

2. A retractor device according to claim 1, wherein said attachment surface is formed on a flat disc shaped member, and wherein said stem extends integrally from a center of said member and extends perpendicularly relative to said attachment surface.

3. A retractor device according to claim 2, wherein said housing has a rear wall with an outer periphery, and said member extends from said rear wall and is positioned entirely within a boundary defined by said outer periphery of said rear wall.

4. A retractor device according to claim 1, further comprising an adhesive located on said attachment surface.

5. A retractor device according to claim 4, wherein said adhesive is provided as a piece of double sided adhesive tape.

6. A retractor device according to claim 1, further comprising a hook and loop fastener extending from said attachment surface.

7. A retractor device according to claim 1, wherein said attachment surface is an attachment clip.

8. A retractor device according to claim 7, wherein said attachment clip is a belt clip.

9. A retractor device according to claim 1, wherein said attachment surface is a suction cup.

10. A retractor device according to claim 1, wherein said stem is a separate headed fastener which connects to said attachment surface.

11. A retractor device, comprising:

a housing having an oval shape in plan with a markedly tapered end, an opposite end, and a channel extending transversely therethrough;

a reel being rotatably mounted within said opposite end of said housing, said reel having a cable hub and a spring hub, and said channel extending axially through said reel along an axis of rotation of said reel;

a cable wound on said reel hub and having a terminal end extending exteriorly of said housing, said cable being extendable from said housing and being retractable onto said reel hub, said terminal end having an end fitting and being prevented from retracting completely into said housing;

a constant force spring located in said housing for retracting said cable with substantially constant pull throughout full extension of said cable, said spring having a first wound portion positioned hub-free in said tapered end of said housing and a second wound portion wound on said spring hub of said reel in an opposite direction relative to said first wound portion such that, as said spring unwinds from said tapered end, it winds onto said spring hub, and as said spring unwinds from said spring hub, it winds into said tapered end; and an attachment component extending within said channel such that said housing is rotatably mounted to said attachment component, said attachment component being a swivel having an attachment surface located exteriorly of said housing, said swivel having a stem which extends into said channel and defines an axis of rotation of said housing about said swivel and of said reel.

12. A retractor device according to claim 11, wherein said swivel has a disc shaped member on which the attachment surface is located, and wherein said stem extends integrally from a center of said member and extends perpendicularly relative to said attachment surface.

13. A retractor device according to claim 12, wherein said housing has a rear wall with an outer periphery, and said member extends from said rear wall and is positioned entirely within said outer periphery of said rear wall.

14. A retractor device according to claim 11, wherein a fastener extends from said attachment surface, and wherein said fastener is selected from the group consisting of a double sided tape, a hook and loop fastener, an attachment clip, and a suction cup.

15. A retractor device according to claim 11, wherein said stem is a separate headed elongate fastener which extends through said channel and connects to said attachment surface.

* * * * *